US005090922A

United States Patent [19]

Rymer et al.

[11] Patent Number: 5,090,922

[45] Date of Patent: Feb. 25, 1992

[54] TERMINAL BLOCK WITH MULTIPLE TRACK MOUNTING CAPABILITY

[75] Inventors: Phil R. Rymer, Asheville; Rex V. Cutshall, Fletcher; Bo S. Ahn, Asheville, all of N.C.

[73] Assignee: Square D Company, Palatine, Ill.

[21] Appl. No.: 632,235

[22] Filed: Dec. 20, 1990

[51] Int. Cl.[5] ..... H01R 9/26

[52] U.S. Cl. ..... 439/716

[58] Field of Search ..... 439/94, 712, 713, 714, 439/709, 715, 716, 717, 723, 724

[56] References Cited

U.S. PATENT DOCUMENTS 3,992,074 11/1976 Rymer ..... 439/716
4,113,982 9/1978 Glaesel ..... 439/716 X
4,157,858 6/1979 Debaigt ..... 439/716
4,647,141 3/1987 Muench et al. ..... 439/716
4,707,563 11/1987 Conrad et al. ..... 439/716 X

FOREIGN PATENT DOCUMENTS 0300065 1/1989 European Pat. Off. ..... 439/716

*Primary Examiner*—Neil Abrams
*Assistant Examiner*—Khiem Nguyen
*Attorney, Agent, or Firm*—Michael J. Femal

[57] ABSTRACT

A terminal block adapted for mounting on various domestic and standardized European DIN mounting rails. The terminal block incorporates a number of integral, fixed and flexible retaining members. Each retaining member has one or more slots which, in the proper combination, engage various mounting rails for attachment of the terminal block.

7 Claims, 6 Drawing Sheets

TERMINAL BLOCK WITH MULTIPLE TRACK MOUNTING CAPABILITY

FIELD OF THE INVENTION

This invention relates to electrical terminal blocks for mounting on various tracks or DIN rails, and more particularly, to a universally mounting electrical terminal block for electrical control panels.

BACKGROUND OF THE INVENTION

In the United States it has been customary for manufacturers of terminal blocks to design their terminal blocks for mounting only on their mounting rails. In Europe, terminal block manufacturers have designed their terminal blocks to mount on one or more standardized DIN rails. The lack of a standardized mounting system has in many cases required the end user to purchase additional mounting rails to accommodate the terminal blocks of various manufacturers.

SUMMARY OF THE INVENTION

It is the object of this invention to permit a terminal block to be mounted on a number of different mounting rails including domestic mounting rails and the standardized European DIN 1, DIN 3, and miniature DIN (15 mm×5 mm) mounting rails. The objective is achieved by providing on the terminal block base, a number of retaining members, some being flexible and others being fixed, such that various combinations of the flexible and fixed members permit the terminal block to mount on the various mounting rails.

Other features and advantages of the invention will become apparent to those skilled in the art upon review of the following detailed description, claims and drawings.

Figure 1:
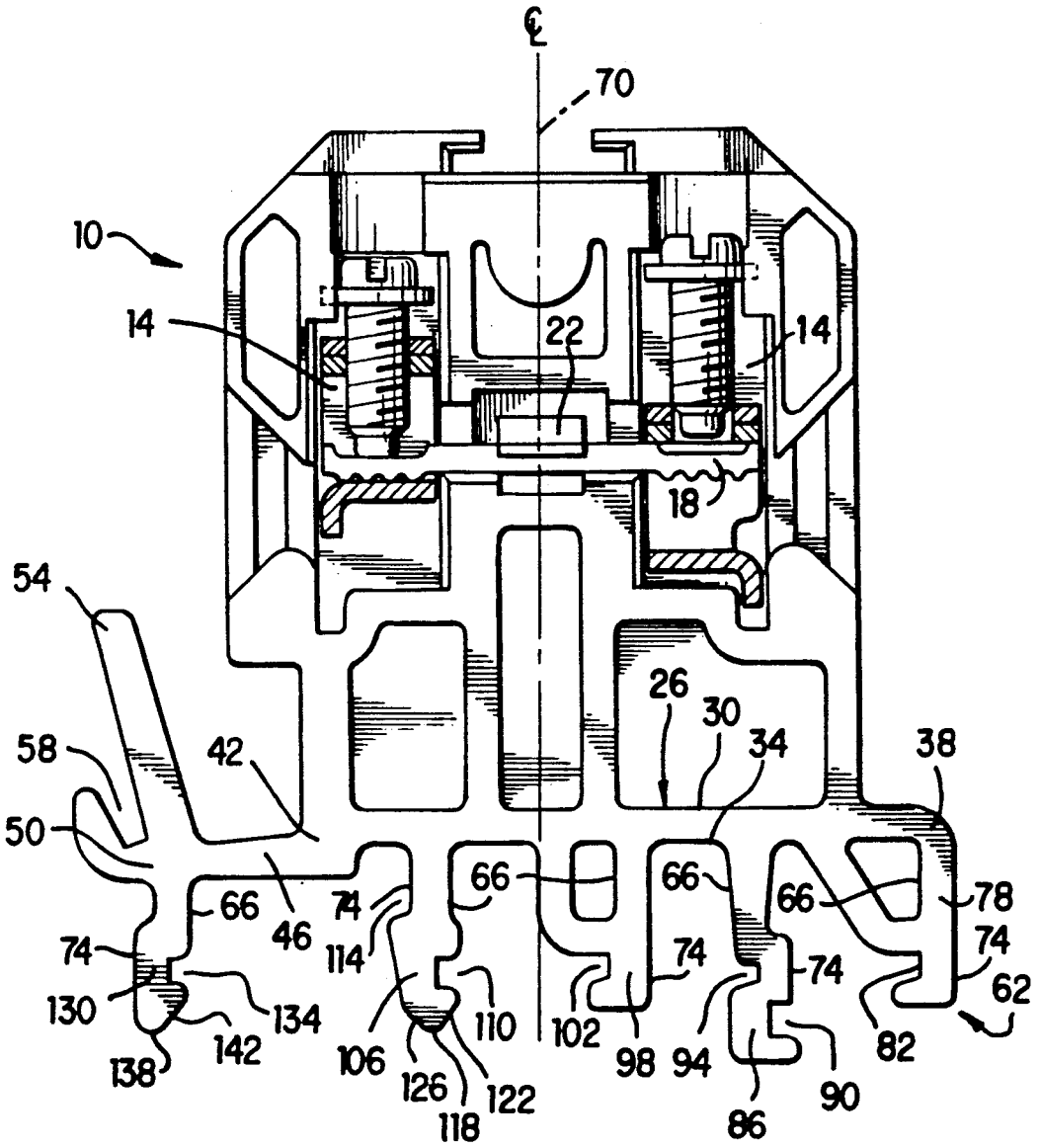
FIG. 1 is a cross sectional side view of the terminal block.

Before one embodiment of the invention is explained in detail, it is to be understood that the invention is not limited in its application to the details of construction and description or illustrated in the drawings. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

The terminal block 10 of FIG. 1 is adapted for mounting on various domestic and standardized DIN mounting rails. The terminal block 10 includes two terminal connectors 14 and a bus bar 18 electrically connecting the two terminal connectors 14. The terminal block 10 also includes a bus bar retaining tab 22 for securely holding the bus bar 18 in the terminal block 10. One end of the terminal block 10 forms a base 26 having an inside surface 30 facing the bus bar 18, and an outside surface 34 facing away from the bus bar 18. The base 26 also includes a first end 38 and a second end 42.

A flexing arm 46 is moveably attached to the second end 42 of the base 26. The flexing arm 46 extends generally parallel to the longitudinal axis of the base 26 and has an extended end 50.

A release arm 54 extends at an obtuse angle relative to the longitudinal axis of the flexing arm 46. The release arm 54 acts as a lever to provide pivotal movement of the flexing arm 46 about its connection at the second end 42 of the base 26. The release arm 54 also includes a screwdriver slot 58 for inserting a screwdriver to effectively increasing the length of the lever formed by the release arm 54.

A plurality of retaining members 62 are integrally formed from the base 26 and spaced apart one from another along the longitudinal axis of the base 26. The retaining members 62 extend perpendicular to the outside surface 34 of the base 26. Each retaining members 62 has an inside surface 66 facing the vertical center line 70 of the terminal block 10 and an outside surface 74 facing away from the center line 70 of the terminal block 10.

The first retaining member 78 extends from the first end 38 of the base 26 and has a rail slot 82 on its inside surface 66. The first retaining member 78 is rigidly connected to the base 26.

The second retaining member 86 is spaced apart a predetermined distance from and immediately adjacent the first retaining member 78 and has a rail slot 90 on its outside surface 74 and a rail slot 94 on its inside surface 66. The second retaining member 86 is flexibly connected to the base 26.

The third retaining member 98 is spaced a predetermined distance from and immediately adjacent to the second retaining member 86 and has a rail slot 102 on its inside surface 66. The third retaining member 98 is rigidly connected to the base 26.

The fourth retaining member 106 is spaced a predetermined distance from and immediately adjacent the third retaining member 98 and has a rail slot 110 on its inside surface 66 and a rail slot 114 on its outside surface 74. The fourth retaining member 106 has a rounded end 118 and a first beveled surface 122 leading to its inside surface 66 and a second beveled surface 126 leading to its outside surface 74. The fourth retaining member 106 is flexibly connected to the base 26.

A fifth retaining member 130 is spaced a predetermined distance from and immediately adjacent the fourth retaining member 106 and extends perpendicular to the extended end 50 of the flexing arm 46. The fifth retaining member 130 has a rail slot 134 on its inside surface 66 and a rounded end 138 with a beveled surface 142 leading to its inside surface 66. The fifth retaining member 130 is moved as the flexing arm 46 is pivoted about the second end 42 of the base 26.

Figure 2:
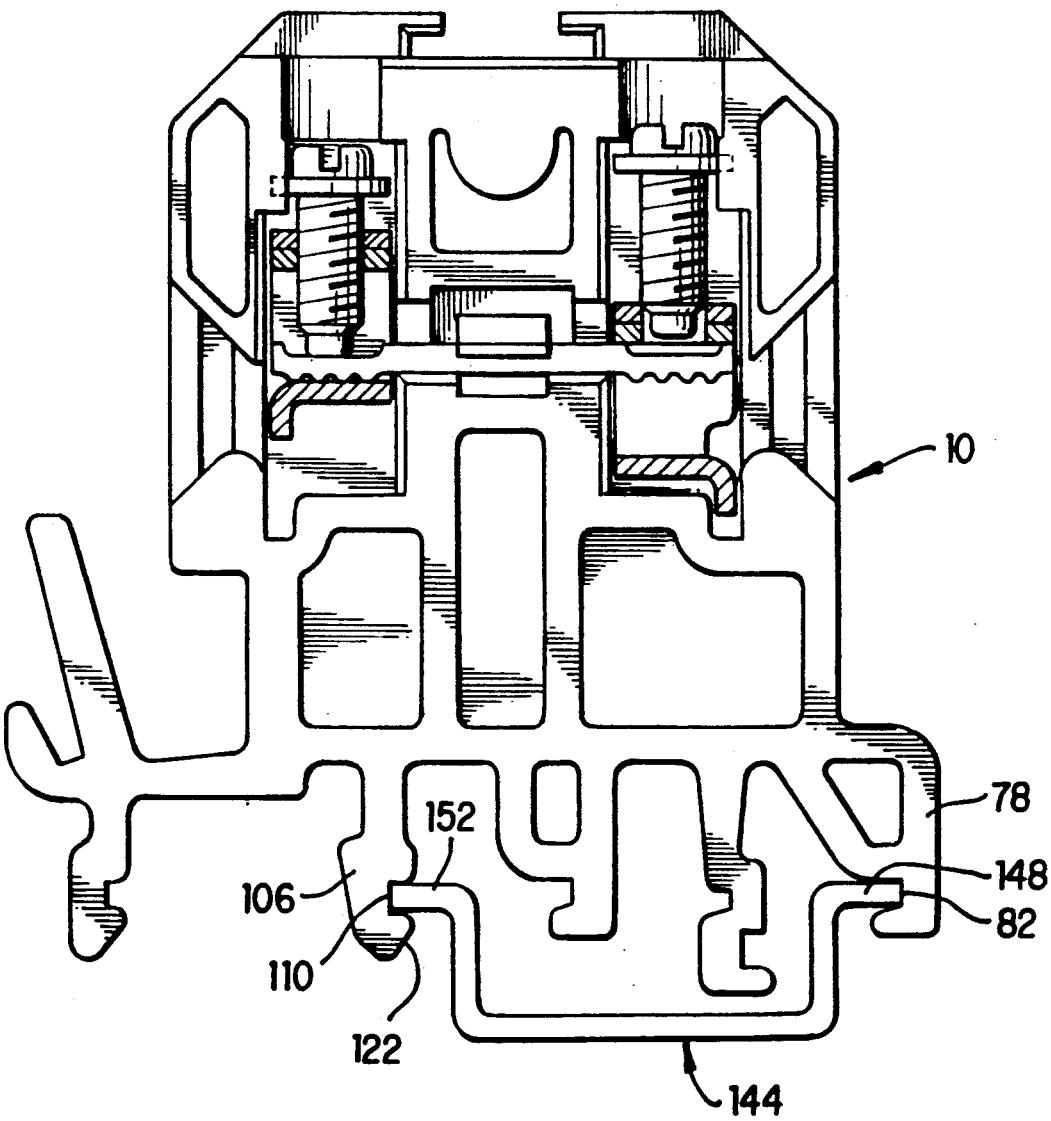
FIG. 2 is a cross sectional side view of the terminal block installed on an Allen Bradley mounting rail.

In FIG. 2, the terminal block 10 is mounted on an Allen Bradley mounting rail 144. This is accomplished by inserting a first flange 148 of the Allen Bradley mounting rail 144 into the inward facing slot 82 of the first retaining member 78. The terminal block 10 is then rotated about the first flange 148 until a second flange 152 contacts the first beveled surface 122 of the flexible fourth retaining member 106. The fourth retaining member 106 flexes away from the second flange 152 permitting the second flange 152 to slid up the first beveled surface 122 of the fourth retaining member 106 and into the inward facing slot 110. The terminal block 10 is removed from the Allen Bradley mounting rail 144 by pushing on the terminal block 10 in such a manner that the fourth retaining member 106 flexes allowing the second flange 152 to disengage from the inward facing slot 110 of the fourth retaining member 106. This flexing and removal of the block 10 may be accomplished by pushing release arm 54 with or without a screwdriver in slot 58 as a lever or simply by pushing a thumb against release arm 54 to flex it.

Figure 3:
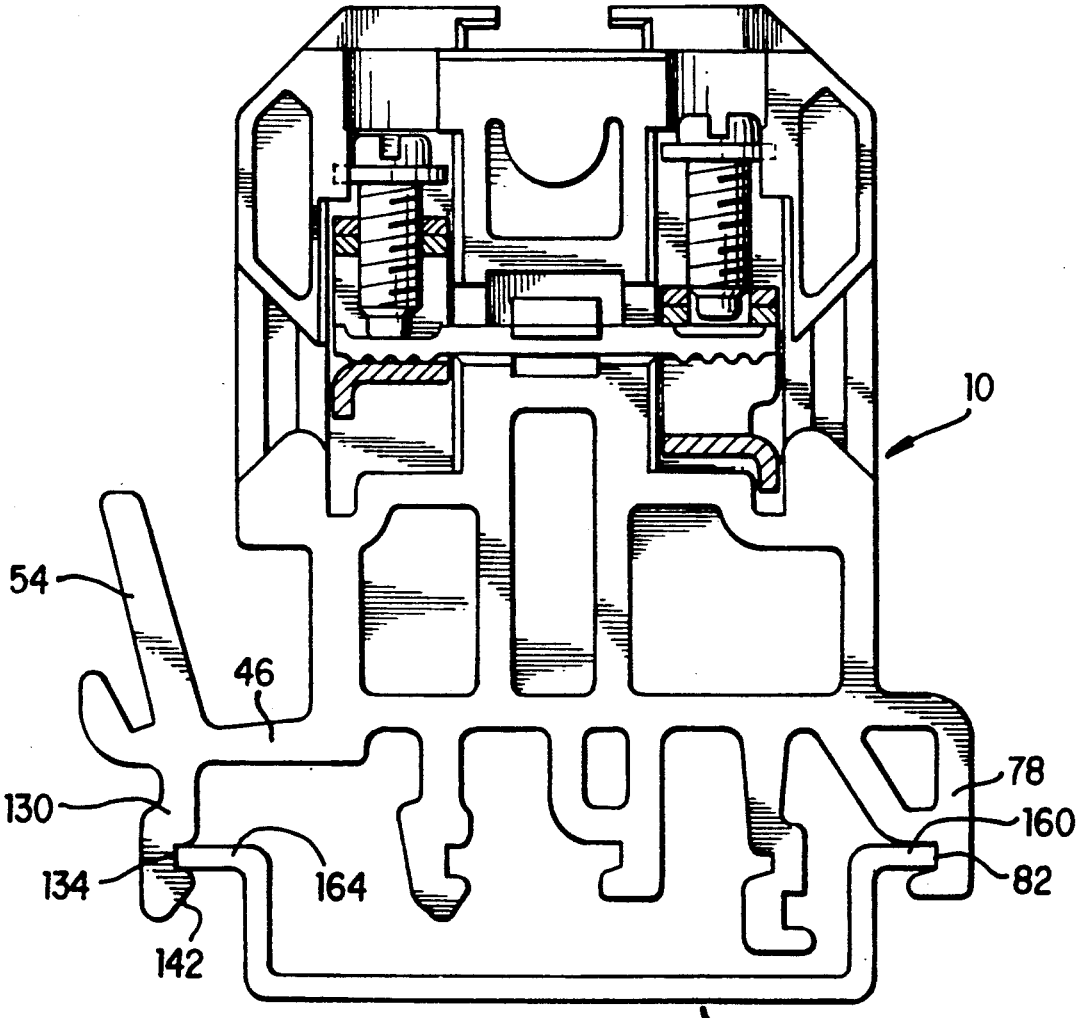
FIG. 3 is a cross sectional side view of the terminal block installed on a DIN 3 mounting rail.

In FIG. 3, the terminal block 10 is mounted on a DIN 3 mounting rail 156. This is accomplished by inserting a first flange 160 of the DIN 3 rail 156 into the inward facing slot 82 of the first retaining member 78. The terminal block 10 is rotated about the first flange 160 until a second rail 164 contacts the beveled surface 142 of the fifth retaining member 130. The flexing arm 46 pivots causing the fifth retaining member 130 to move away from the second flange 164. The second flange 164 slides up the beveled surface 142 of the fifth retaining member 130 and into the inward facing slot 134. The terminal block 10 is released from the DIN 3 mounting rail 156 by pushing the release arm 54 inwardly toward the body of the terminal block 10 which causes the flexing arm 46 to pivot and the fifth retaining member 130 to move away from the second flange 164. This movement releases the second flange 164 from the inward facing slot 134 of the fifth retaining member 130.

Figure 4:
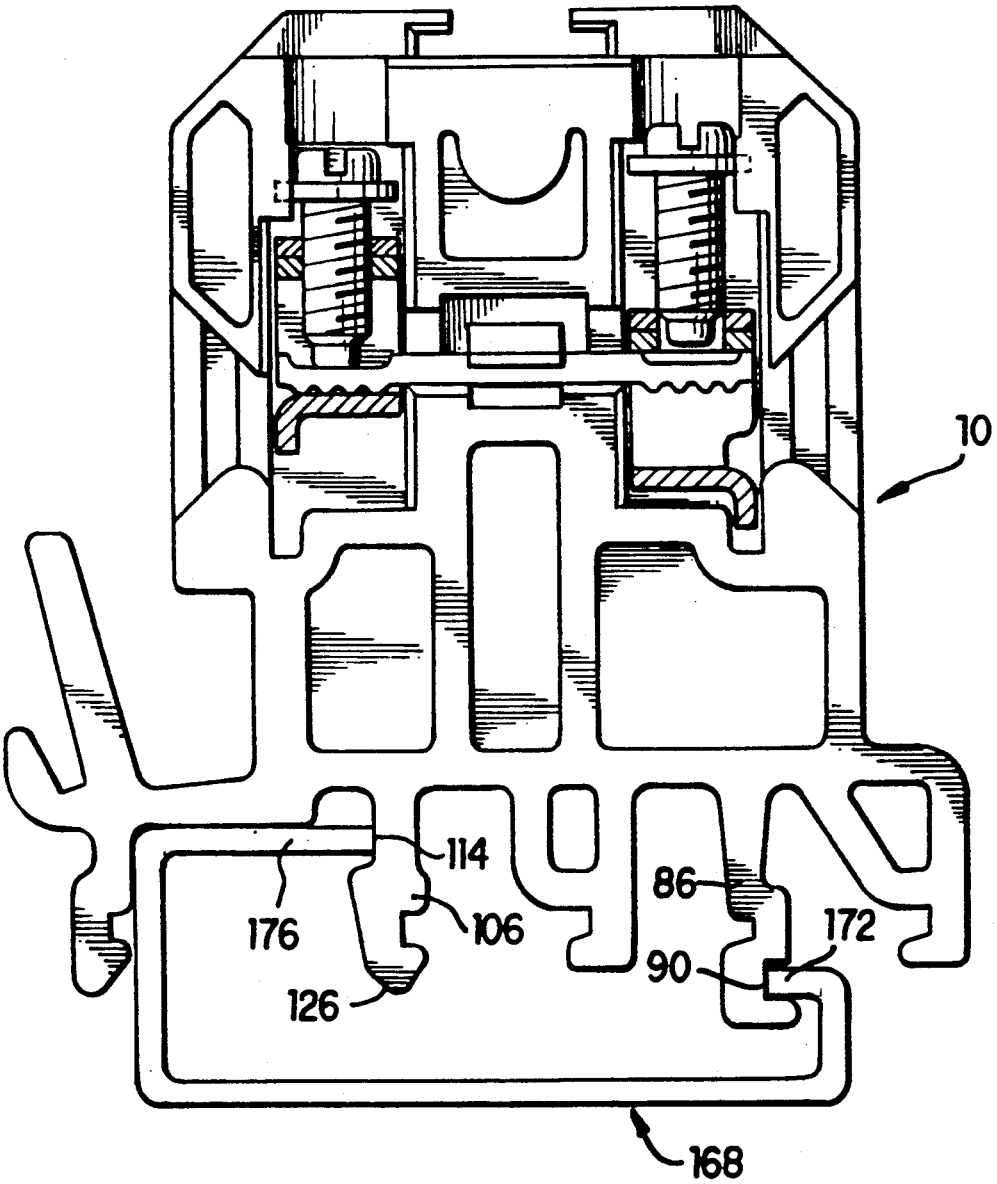
FIG. 4 is a cross sectional side view of the terminal block installed on a DIN 1 mounting rail.

In FIG. 4, the terminal block 10 is mounted on a DIN 1 mounting rail 168. This is accomplished by inserting a first flange 172 of the DIN 1 mounting rail 168 into the outward facing slot 90 of the second retaining member 86. The terminal block 10 is rotated about the first flange 172 until a second flange 176 engages the second beveled surface 126 of the fourth retaining member 106. The fourth retaining member 106 flexes away from the second flange 176 permitting the second flange 176 to slide up the second beveled surface 126 of the fourth retaining member 106 and into the outward facing slot 114. The terminal block 10 is released from the DIN 1 mounting rail 168 by pushing the terminal block 10 such that the second retaining member 86 flexes permitting the second flange 176 to disengage from the outward facing slot 114 of the fourth retaining member 106.

Figure 5:
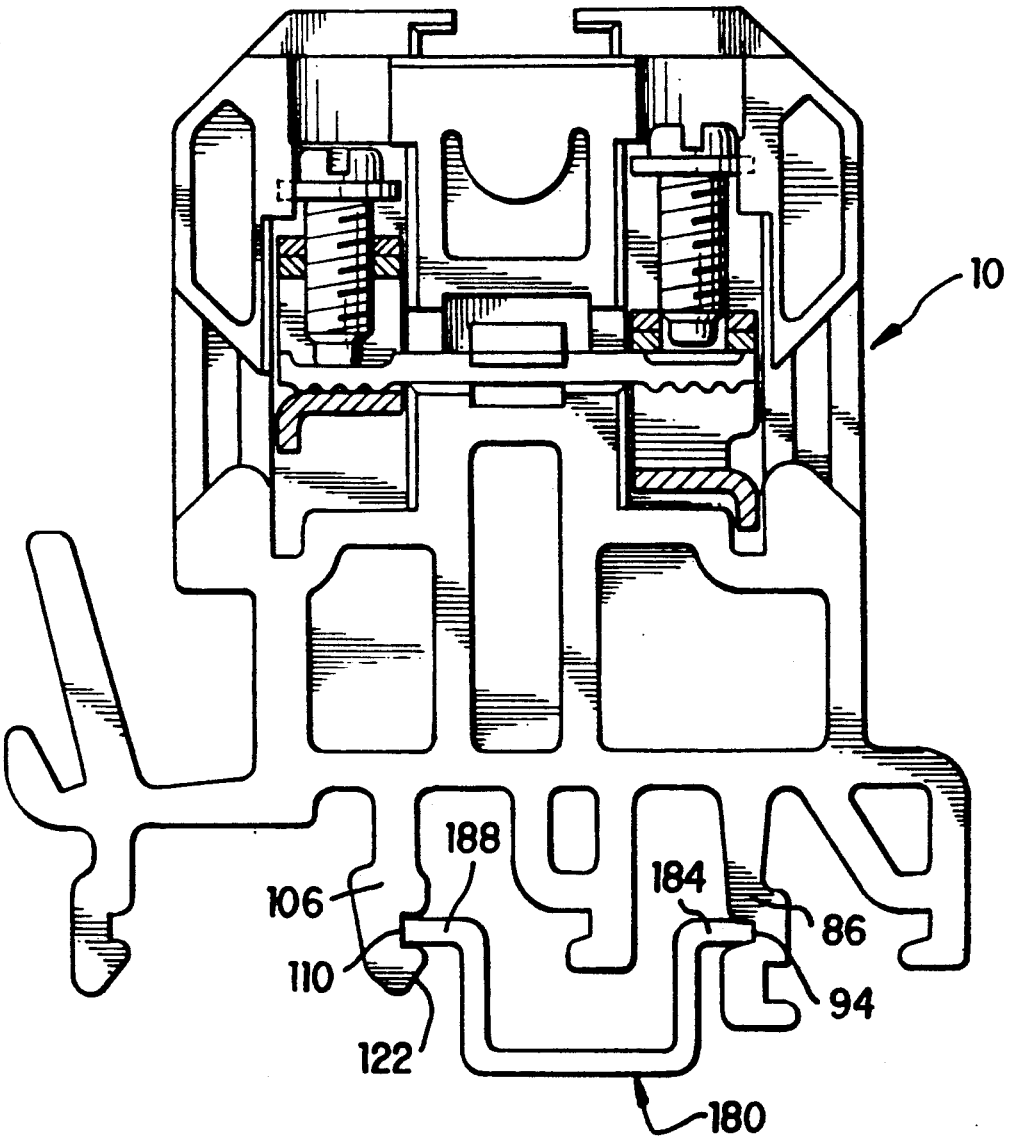
FIG. 5 is a cross sectional side view of the terminal block installed on a DIN Mini (15 mm×5 mm) mounting rail.

In FIG. 5, the terminal block 10 is mounted on a DIN Mini mounting rail 180. This is accomplished by inserting a first flange 184 of the DIN Mini mounting rail 180 into the inward facing slot 94 of the second retaining member 86. The terminal block 10 is rotated about the first flange 184 such that a second flange 188 contacts the first beveled surface 122 of the fourth retaining member 106. The fourth retaining member 106 flexes such that the second flange 188 slides up the first beveled surface 122 of the fourth retaining member 106 and into the inward facing slot 110 of the fourth retaining member 106. The terminal block 10 is released from the DIN Mini mounting rail 180 by pushing the terminal block 10 such that the fourth retaining member 106 flexes permitting the second flange 188 to disengage from the inward facing slot 110 of the fourth retaining member 106.

Figure 6:
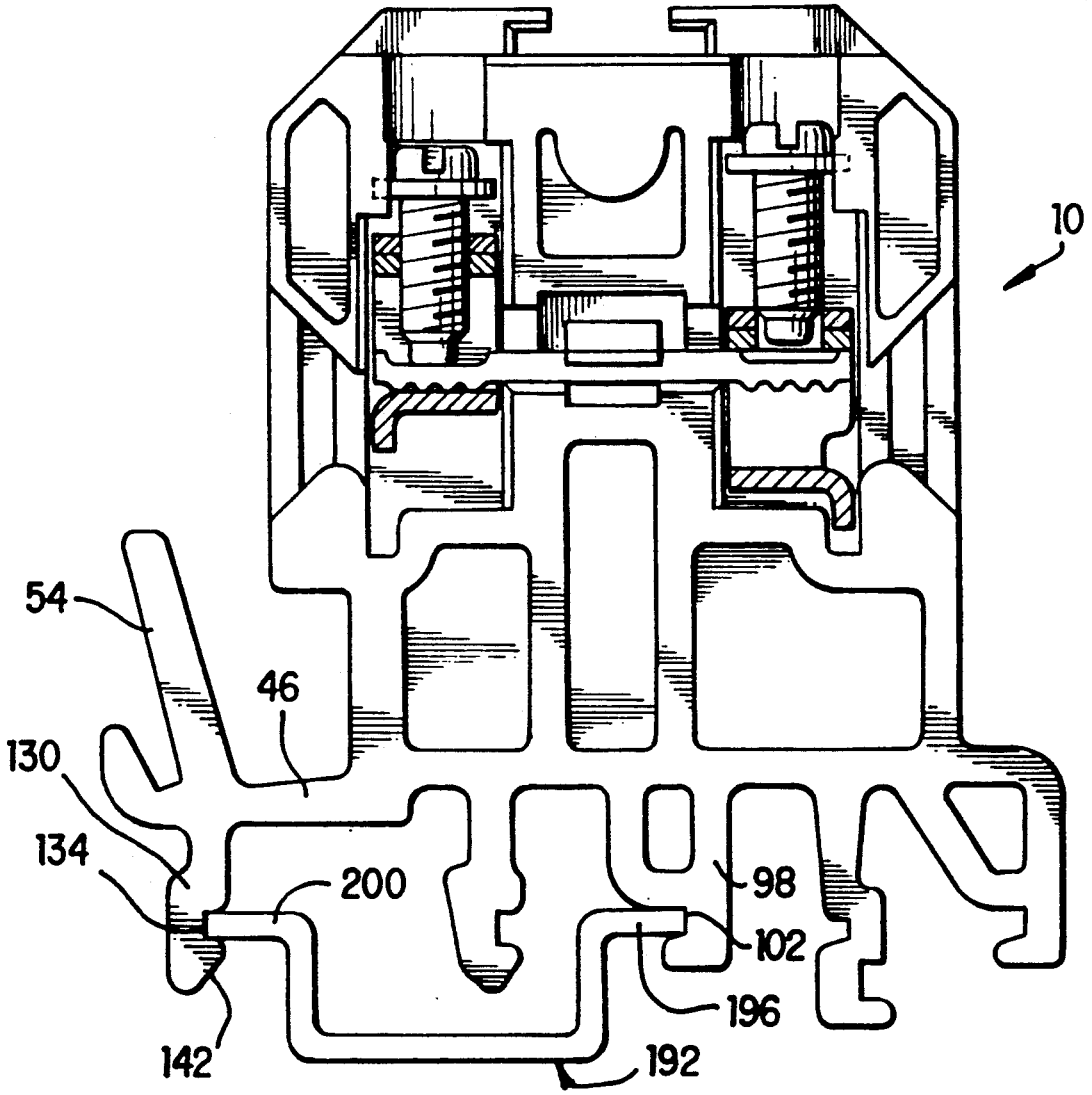
FIG. 6 is a cross sectional side view of the terminal block installed on a Square D mounting rail.

In FIG. 6, the terminal block 10 is mounted on a Square D mounting rail 192. This is accomplished by inserting a flange 196 of the Square D mounting rail 192 into the inward facing slot 102 of the third retaining member 98. The terminal block 10 is rotated about the first flange 196 such that a second flange 200 contact the beveled surface 142 of the fifth retaining member 130. The flexing arm 46 pivots causing the fifth retaining member 130 to move away from the second flange 200. The second flange 200 slides up the beveled surface 142 of the fifth retaining member 130 and into the inward facing slot 134. The terminal block 10 is released from the Square D mounting rail 192 by pushing the release arm 54 toward the terminal block 10. The movement of the release arm 54 inwardly toward the body of the terminal block 10 causes the flexing arm 46 to pivot and the fifth retaining member 130 to move away from the second flange 200. This movement permits the inward facing slot 134 of the fifth retaining member 130 to release the second flange 200 of the Square D mounting rail 192.

What we claim is:

1. A terminal block adapted for mounting on various mounting rails, said terminal block being generally rectangular in shape, having terminal connectors for connecting external electrical conductors, a bus bar for electrically connecting the terminal connectors together, means for retaining the bus bar in the terminal block, and comprising:

a) a base forming one end of said terminal block, said base having an inside surface facing said bus bar, an outside surface facing away from said bus bar, a first end, and a second end;

b) a plurality of retaining members, each integrally formed from said base, spaced apart one from another a predetermined distance along the longitudinal axis of said base, and extending downwardly perpendicularly to said outside surface of said base, a predetermined length, at least two said retaining members cooperating together for attaching said terminal block to the various sized mounting rails;

c) a flexing arm, having a first end moveably attached to said second end of said base and an extended end, said flexing arm having a longitudinal axis parallel to the longitudinal axis of said base;

d) a release arm, extending from said extended end of said flexing arm at an obtuse angle with respect to the longitudinal axis of said flexing arm, said release arm acting as a lever to cause a pivotal movement of said flexing arm which in turn selectively flexes one or more retaining members for quick release of the terminal block;

e) a screwdriver slot immediately adjacent said release arm for inserting a screwdriver to increase the effective lever length of said release arm; and f) wherein each said retaining member has an inside surface facing toward the center line of said terminal block, an outside surface facing away from the center line of said terminal block, and a slot running perpendicular to the longitudinal axis of said retaining member on one or both of said inside and outside surfaces, said plurality of retaining members comprising:

1. a first retaining member extending from said first end of said base and having a slot on said inside surface;

2. a second retaining member immediately adjacent and spaced apart a predetermined distance from said first retaining member and having a slot on said inside and said outside surfaces;

3. a third retaining member immediately adjacent and spaced apart a predetermined distance from said second retaining member and having a slot on said inside surface;
4. a fourth retaining member immediately adjacent and spaced apart a predetermined distance from said third retaining member, said fourth retaining member having a rounded end with a first beveled surface leading to said outside surface and having a slot on said inside surface and said outside surface; and
5. a fifth retaining member immediately adjacent and spaced a predetermined distance apart and parallel to said fourth retaining member, extending perpendicularly from said extended end of said flexing arm said fifth retaining member having a rounded end with a beveled surface leading to said inside surface and a slot on said inside surface.

2. A terminal block as claimed in claim 1 wherein said first and third retaining members are rigidly connected to said base and said second and fourth retaining members are flexibly connected to said base.

3. A terminal block as claimed in claim 2 wherein said inward facing slot of said first retaining member and said inward facing slot of said fourth retaining member are spaced apart and in opposed relationship one to one another such that the two oppositely extending flanges of an Allen Bradley mounting rail engage said slots by inserting a first mounting rail flange into said inward facing slot of said first retaining member and rotating said terminal block about the first flange such that the second flange engages said first beveled surface of said fourth retaining member causing said fourth retaining member to pivot away from the flange permitting the second flange to slide into said inward facing slot of said fourth retaining member.

4. A terminal block as claimed in claim 2 wherein said inward facing slot of said first retaining member and said inward facing slot of said fifth retaining member are spaced apart and in opposed relationship one to one another such that the two oppositely extending flanges of a DIN 3 mounting rail are engaged by inserting a first mounting rail flange into said inward facing slot of said first retaining member and rotating said terminal block about the first flange such that the second flange engages said beveled surface of said fifth retaining member causing said flexing arm to pivot thereby moving said fifth retaining member away from the flange permitting the second flange to slide into said inward facing slot of said fifth retaining member.

5. A terminal block as claimed in claim 2 wherein said outward facing slot of said second retaining member and said outward facing slot of said fourth retaining member are spaced apart such that the two inwardly extending flanges of a DIN 1 mounting rail are engaged by inserting a first mounting rail flange into said outward facing slot of said second retaining member and rotating said terminal block about the first flange such that the second flange engages said second beveled surface of said fourth retaining member as another surface of the DIN 1 mounting rail engages said inside surface of said fifth retaining member, said second retaining member pivots permitting the second flange to slide into said outward facing slot of said fourth retaining member.

6. A terminal block as claimed in claim 2 wherein said inward facing slot of said second retaining member and said inward facing slot of said fourth retaining member are spaced apart and in opposed relationship one to one another such that the two oppositely extending flanges of a DIN Mini Rail are engaged by inserting a first mounting rail flange into said inward facing slot of said second retaining member and rotating said terminal block about the first flange such that the second flange engages said first beveled surface of said fourth retaining member causing said fourth retaining member to pivot away from the flange permitting the second flange to slide into said inward facing slot of said fourth retaining member.

7. A terminal block as claimed in claim 2 wherein said inward facing slot of said third retaining member and said inward facing slot of said fifth retaining member are spaced apart and in opposed relationship one to one another such that the two oppositely extending flanges of a Square D mounting rail engage said slots by inserting a first mounting rail flange into said inward facing slot of said third retaining member and rotating said terminal block about the first flange such that the second flange engages said beveled surface of said fifth retaining member causing said flexing arm to pivot causing said fifth retaining member to move away from the flange permitting the second flange to slide into said inward facing slot of said fifth retaining member.

* * * * *